US005772450A

United States Patent [19]

Bernardini

[11] Patent Number: 5,772,450

[45] Date of Patent: Jun. 30, 1998

[54] ELECTRICAL CONNECTORS HAVING EXTERNAL CIRCUIT CONNECTIONS

[75] Inventor: Allen J. Bernardini, Southbury, Conn.

[73] Assignee: Litton Systems, Inc., Watertown, Conn.

[21] Appl. No.: 685,168

[22] Filed: Jul. 23, 1996

[51] Int. Cl.[6] ..... H01R 9/09

[52] U.S. Cl. ..... 439/67; 439/493

[58] Field of Search ..... 439/66, 67, 77, 439/493, 591

[56] References Cited

U.S. PATENT DOCUMENTS 5,007,842 4/1991 Deak et al. ..... 439/77

FOREIGN PATENT DOCUMENTS 3-292794 12/1991 Japan ..... 439/67

*Primary Examiner*—Khiem Nguyen
*Assistant Examiner*—Eugene G. Byrd
*Attorney, Agent, or Firm*—Michael H. Wallach

[57] ABSTRACT

A pad-to-pad connection arrangement between adjacent electrical connectors, such as "bump-to-bump", "bump-to-hollow", or "bump-to-flat" pad arrangements, is achieved. Pads on the surface of an electrical connector may be selectively connected to conductive traces also on the surface of the electrical connector. When two adjacent electrical connectors are joined together in a side-by-side, adjacent relationship, the electrical pads along the side surfaces of the electrical connectors mate, thereby resulting in electrical connections being formed between mated pads of the electrical connectors. According to a preferred embodiment of the present invention, a flexible circuit containing the conductive traces and surface pads is formed about an electrical connector.

32 Claims, 3 Drawing Sheets

ELECTRICAL CONNECTORS HAVING EXTERNAL CIRCUIT CONNECTIONS

BACKGROUND OF THE INVENTION

The present invention relates generally to electrical connectors and more specifically to electrical connectors having external circuit connections.

Known electronic packaging techniques utilized in a variety of industries, such as the telecommunications and computer industries, require electrical connectors which can be mounted onto a PCB (printed circuit board), backplane or flexible circuit. The electrical connectors are thus dependent upon these mediums to provide the electrical connection between discrete, adjacent connectors and boards. To this end, the electrically conductive surfaces of the connectors or contacts are typically attached by a trace which can be plated, ink, epoxy, etc. to the terminus attachment of the connector to the PCB, backplane or flexible circuit.

The requirement that prior art electrical connectors must be mounted onto a PCB, backplane or flexible circuit is an undesirable limitation in that packaging density is necessarily limited to the surface area or "real estate" surrounding the PCB, backplane or flexible circuit. As circuitry and systems become more complicated the density demands made on PCBs correspondingly increase as well. There is thus the constant pressure to place more components and connectors on PCBs while at the same time trying to reduce the physical size of the system.

There is thus an unmet need in the art to be able to make more effective use of space in PCBs in response to the increasing density demands of modern circuits and systems.

SUMMARY OF THE INVENTION

It would be advantageous in the art to be able to minimize or eliminate the prior art requirement that electrical connectors be mounted onto a PCB, backplane or flexible circuit to provide electrical connection between discrete, adjacent connectors and boards.

It would further be advantageous in the art to not have the packaging density of a PCB or system unnecessarily limited by the requirement that electrical connectors be mounted onto a PCB, backplane or flexible circuit to provide electrical connection between discrete, adjacent connectors.

Therefore, according to the present invention, a pad-to-pad connection arrangement between adjacent electrical connectors, such as "bump-to-bump", "bump-to-hollow", or "bump-to-flat" pad arrangements, is described. Pads on the surface of an electrical connector may be selectively connected to conductive traces also on the surface of the electrical connector. When two adjacent electrical connectors are joined together in a side-by-side, adjacent relationship, the electrical pads along the side surfaces of the electrical connectors mate, thereby resulting in electrical connections being formed between mated pads of the electrical connectors. This arrangement avoids the need for using a motherboard or back panel by taking advantage of the additional "real estate" on the sides of electrical connectors which are mounted on printed circuit boards.

According to a preferred embodiment of the present invention, an electrical connector has a flexible circuit which is formed about it. Conductive traces of the flexible circuit make electrical connections with pads which are an integral portion of the flexible circuit. The flexible circuit may be "U"-shaped, being formed about a first side surface, a second side surface, and the bottom surface of the electrical connector. When two or more adjacent electrical connectors having pads formed in flexible circuitry are mated in a side-by-side, adjacent relationship, an electrical connection between mated pads is effected.

It is accordingly an object of the invention to overcome the prior art requirement that electrical connectors be mounted onto a PCB, backplane or flexible circuit to provide electrical connection between discrete, adjacent connectors and boards.

This and other objects of the invention will become apparent from the detailed description of the invention in which numerals used through the description correspond to those found in the drawing figures.

BRIEF DESCRIPTION OF THE DRAWINGS

The novel features believed characteristic of the invention are set forth in the appended claims. The invention itself, however, as well as a preferred mode of use, and further objects and advantages thereof, will best be understood by reference to the following detailed description of an illustrative embodiment when read in conjunction with the accompanying drawings, wherein:

DESCRIPTION OF THE INVENTION

The electrical connector of the present invention features conductive surface pads which are electrically connected to conductive traces formed on the surface of the electrical connector. The conductive surface pads may be bump pads, hollow pads, or flat pads as will become evident. The conductive traces may be plated, screened or conductive ink or epoxy electrical traces formed on the surface of the electrical connector; according to a preferred embodiment of the invention, a flexible circuit having conductive traces connected to the surface pads is formed about the electrical connector in a "U"-shape. The conductive traces are attached to the terminus attachment of the PCB, backplane or flexible circuit to which the electrical connector is attached by plating, ink, epoxy or other means known in the art.

The present invention allows the conductive traces which are attached to the terminus attachment of the PCB, backplane or flexible circuit to continue to the sides of the connector in the flexible formed circuit where they terminate in strategically placed conductive pads on the surface of the connector. These conductive pads, i.e. bumps, hollows and flats, are fixed along the side surfaces of the electrical connector such that when two or more electrical connectors are abutted together, electrical connections are created between the conductive pads making contact without the need for an intermediate connection through a PCB, backplane or flexible circuit.

Figure 1:
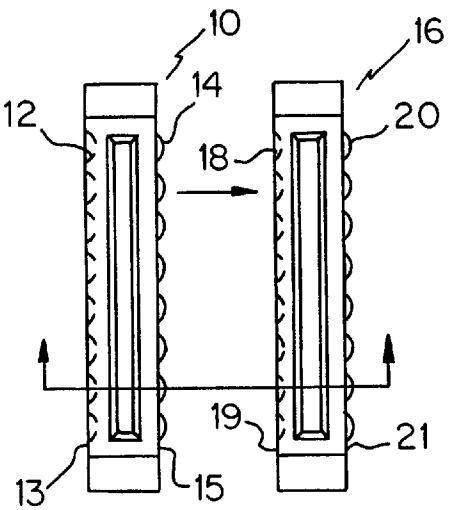
FIG. 1 is a top view of two electrical connectors prior to being mated, according to the present invention.

Referring to FIG. 1, a top view of two electrical connectors, constructed in accordance with the teachings of the invention prior to being mated, is shown. The first connector 10 has a plurality of raised conductive bump pads 14 in a convex shape which are carried on a first side surface 15 of connector 10. A plurality of complementary hollow pads 12 in a concave shape are located along a second side surface 13 of connector 10 which is opposite that of first side surface 15. Similarly, second connector 16 has a plurality of raised conductive bump pads 20 in a convex shape which are carried on a first side surface 21 of connector 16. A plurality of complementary hollow pads 18 in a concave shape are distributed along a second side surface 19 which is opposite that of first side surface 21.

Figure 4:
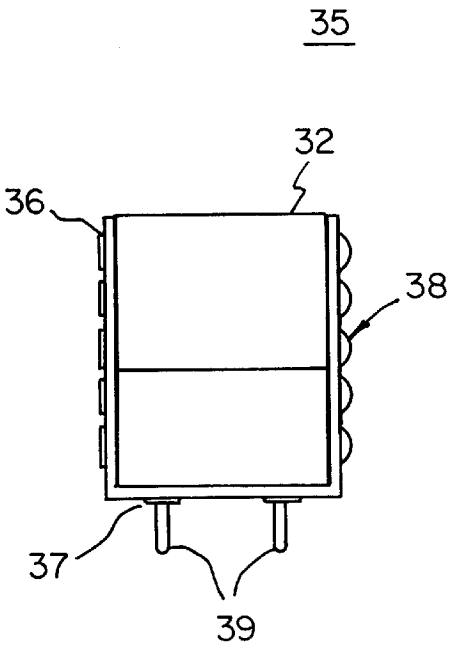
FIG. 4 is an end view of an electrical connector fitted with the flexible formed circuit having integral bumps and hollows, according to the present invention.

Conductive hollow pads 12 and 18 may be conductive "flat" pads of the type shown in FIG. 4, or may be replaced with conductive bump pads similar in shape to conductive bump pads 14 and 20 since it is possible to achieve an electrical connection by mating two conductive bump pads. A bump-to-bump mating arrangement or a bump-to-flat arrangement may be preferable to the bump-to-hollow arrangement of FIG. 2 where the side surfaces of the electrical connector does not have indentations or hollows to seat a hollow pad. In a bump-to-flat mating arrangement, bump pads will readily make electrical contact with flat pads.

Figure 2:
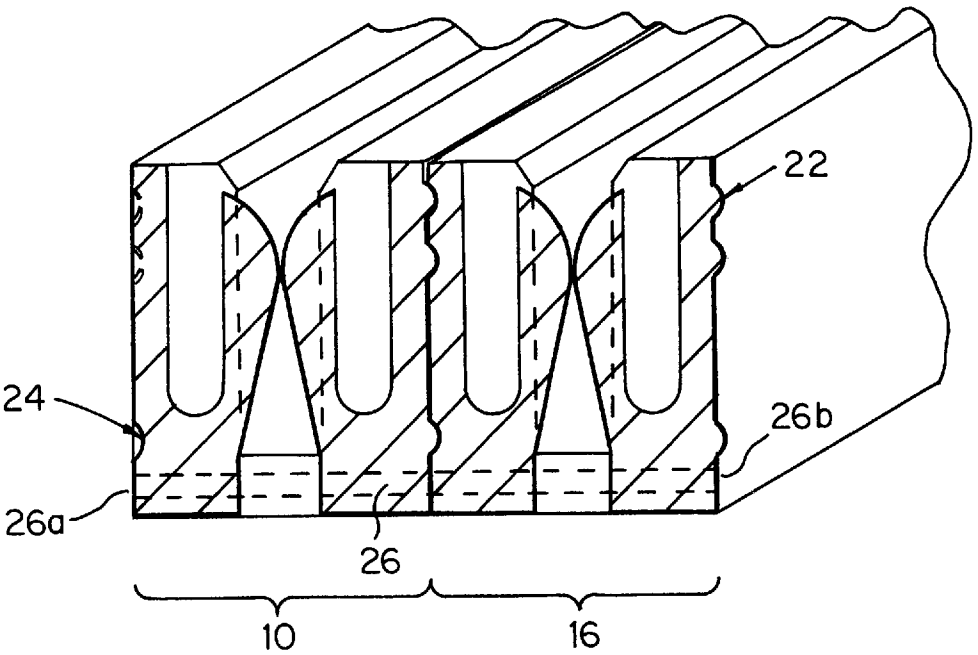
FIG. 2 is an isometric cross-sectional view of two electrical connectors after being mated, according to the present invention.

The bump pads and hollow pads shown on the first connector 10 and the second connector 16 may be connected to conductive traces selectively applied to them so that electrical connections are formed when connectors 10 and 16 are mated as shown in FIG. 2. It should be noted that first connector 10 and second connector 16 each have the same number of bump pads and hollow pads and that these pad elements are distributed at fixed locations along the side surfaces of the connectors so that electrical connections are formed when connectors 10 and 16 are mated together. The locations of pads along the side surface of the connectors may be customized as desired.

Connectors 10 and 16 may be made of all-plastic with the conductive traces along the surface of the connectors being plated, screened or conductive ink or epoxy electrical traces; plastic offers the advantages of electrical insulation, low cost and ease of manufacturing.

Referring now to FIG. 2, an isometric cross-sectional view of connectors 10 and 16 after being mated is shown. Connectors 10 and 16 are adjacent connectors which when mated form electrical connections between corresponding bump pads 22 and hollow pads 24 as shown in the figure. Bump pads 22 are analogous to bump pads 14 and 20 while hollow pads 24 are analogous to hollow pads 12 and 18 of FIG. 1. Electrical connections between connectors 10 and 16 may also be formed if hollow pads 24 were replaced with raised bump pads similar to bump pads 22; in other words, electrical connections can be formed between bump pads that are mated together.

Adjacent connectors 10 and 16 may be joined together as shown in FIG. 2 through the use of a "C" clip over the ends of connectors 10 and 16 or by a screw and nut arrangement passing through a hole 26 of both connectors to join connectors 10 and 16 of the type known in the art. If a screw and nut arrangement is employed, a screw may be inserted through a first end 26a of hole 26, pass through connectors 10 and 16 through hole 26, and emerge at a second end 26b of hole 26 where the screw may be secured with a nut to maintain mating between connectors 10 and 16. Alternately, if bump pads 22 are solder balls, mating between adjacent connectors 10 and 16 may be effected by heating connectors 10 and 16 which causes the solder ball bump pads 22 to reflow into the hollow pads 24 with which they have been placed in contact. Such reflow allows the two adjacent electrical connectors to form a fused solid block which does not require a clamping device to form a solid permanent connection between the adjacent electrical connectors.

According to a preferred embodiment of the present invention, the surface pad elements of the present invention are integrated into a flexible circuit which is wrapped about the sides of the electrical connector of the present invention. The flexible circuit has conductive traces which may be connected to the surface pads; thus, connection to a surface pad of the flexible circuit may allow connection to a conductive trace of the flexible circuit. The conductive traces of the flexible circuit are covered with an insulating layer so that when adjacent electrical connectors are mated, contact between conductive traces of the adjacent electrical connectors is avoided. Contact between adjacent electrical connectors is effected solely by mating surface pad elements.

Figure 3:
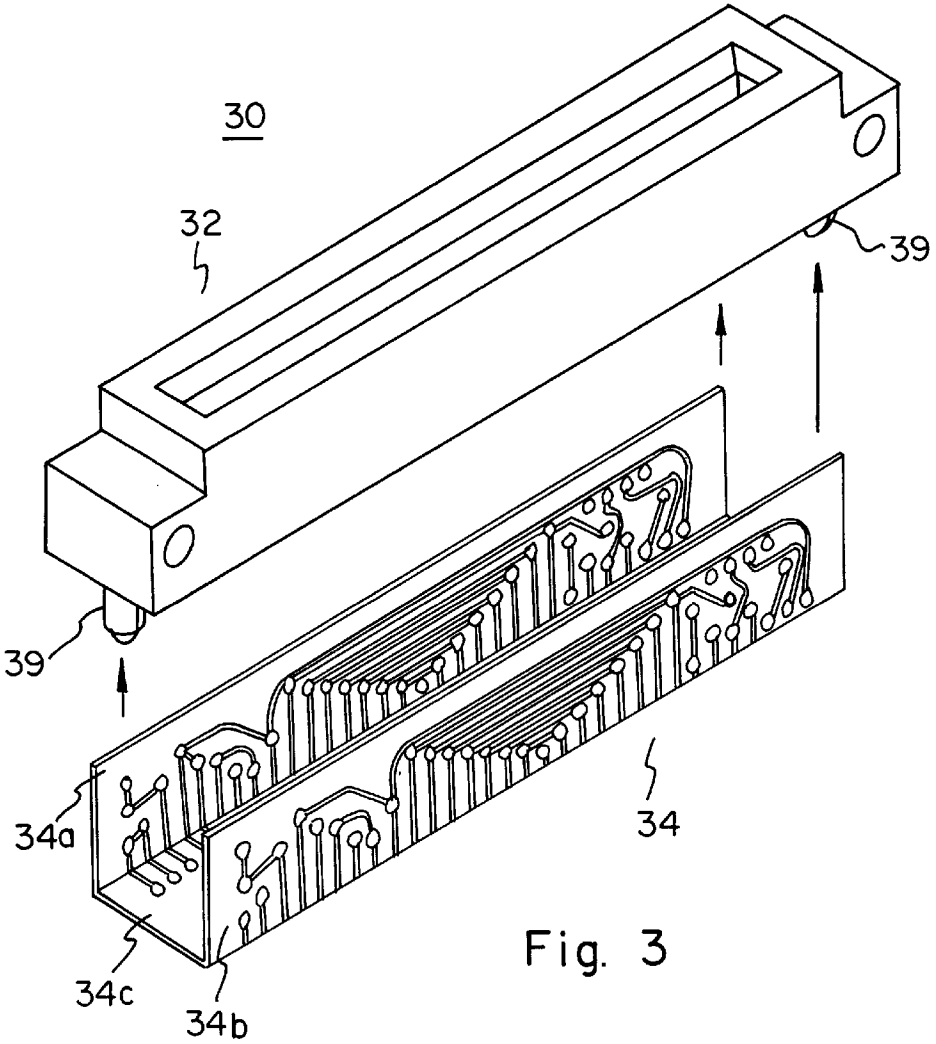
FIG. 3 is an isometric view of a flexible formed circuit having integral bumps and hollows prior to being fitted over side surfaces and bottom surface of an electrical connector, according to the present invention.

Referring to FIG. 3, an isometric view of a flexible circuit 34 having integral bumps and hollows prior to being fitted over the side surfaces and the bottom surface of an electrical connector 32 is shown. In order to accommodate surface pad elements, such as bump pads or hollow pads, flexible circuit 34 need not be very thick. The surface pad elements may be embossed in the flexible circuit 34. Flexible circuit 34 is a "U"-shaped circuit having a first side portion 34*a*, a second side portion 34*b*, and a bottom portion 34*c* and when fitted over the body of electrical connector 32, first side portion 34*a* is formed over a first side surface of electrical connector 32, second side portion 34*b* is formed over a second side surface of electrical connector 32, and bottom portion 34*c* is formed over the bottom surface of electrical connector 32. Flexible circuit 34 adheres to electrical connector 32 as described and terminates to contacts 39 by solder, either surface mount or through hole. Bottom portion 34*c* may additionally include terminations for connecting flexible circuit 34 to additional circuits contained on a printed circuit board to which electrical connector 32 is attached.

FIG. 4 is an end view of electrical connector 32 fitted with the flexible circuit 34 having integral bump pads 38 and hollow or flat pads 36. This end view illustrates the bump pads 38 and hollow pads 36 which are integrated into flexible circuit 34. Flexible circuit 34 extends from bump pads 38 to contact pads 39 and from hollow or flat pads 36 to contacts 39. As shown in the figure, there is a plated thru-hole 37 for connection of flexible circuit 34 to contacts 39. Additionally, flexible circuit 34 is connected to the connector contacts 39 through solder, paste, conductive adhesive or other means known in the art. Further, contacts 39 may protrude through flexible circuit 34 to make contact with a PCB via conventional means such as solder, press-fit, etc.

Figure 6:
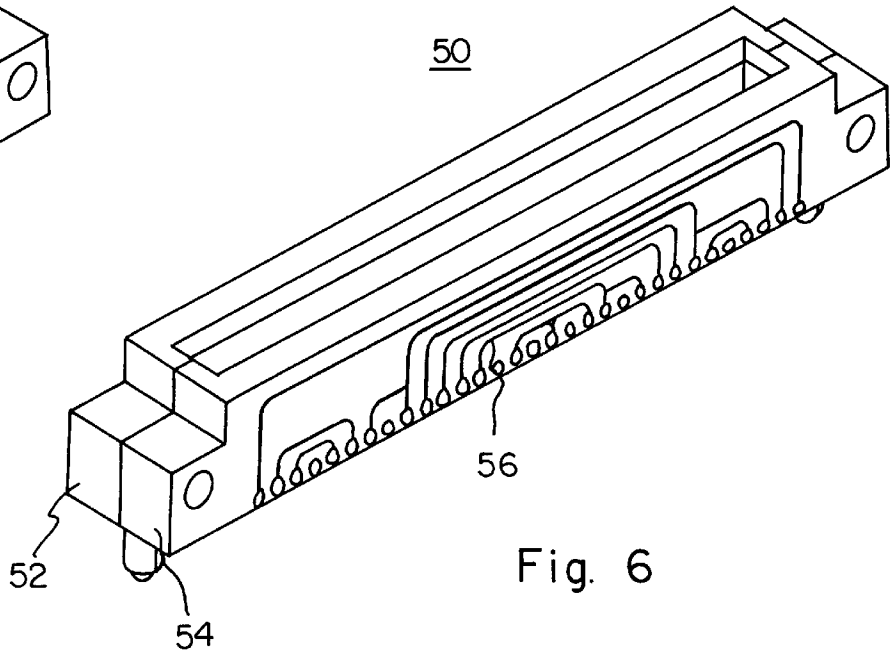
FIG. 6 is a view of a two piece electrical connector, according to the present invention.
Figure 5:
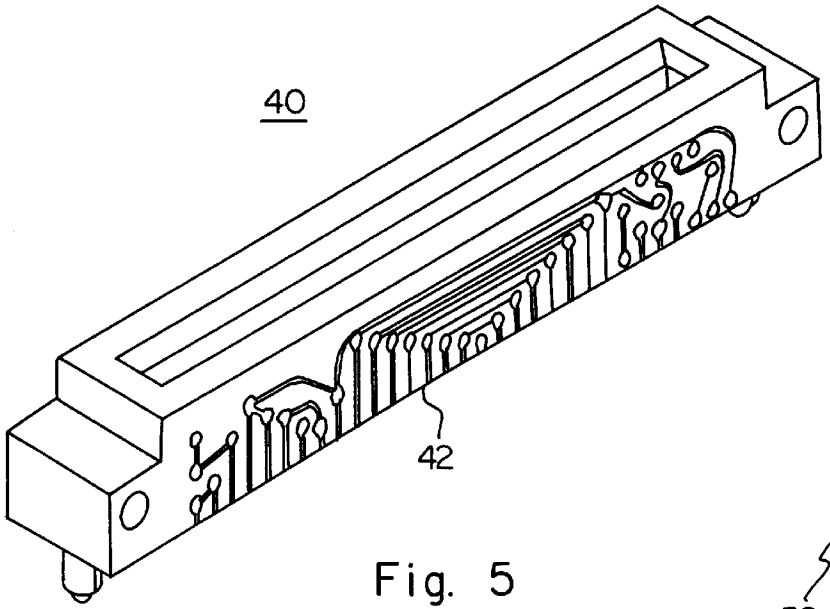
FIG. 5 is a view of a one piece electrical connector, according to the present invention.

As previously mentioned, the conductive traces continue onto the sides of the connector where they terminate in a strategically placed surface pad. Referring to FIG. 5, these traces 42 are clearly shown along the side edge of a one piece connector 40. Referring to FIG. 6, traces 56 can be seen along the side edge of connector 50. Connector 50, in this example, is manufactured in two pieces, 52 and 54.

The traces along the outside edge of the connector can be customized such that circuitry can also be applied on the side of the insulator housing to provide interconnections between contacts on the same connector. In addition, provisions can be made to adhere, attach or imbed surface mount components on these side surfaces to provide additional circuit "real estate", with the ultimate goal being a system of plugin PCBs and mating connectors which interconnect with each other to provide an innovative electronic packaging system which does not require a traditional backplane or mother board. To increase density, double, triple or quadruple edged PCBs can be used with two or more connectors. The interface geometries which may be used include, but are not limited to, opposing conductive surface pad elements such as bump pads, hollow pads, and flat pads.

A "bump and hollow" connection arrangement for adjacent electrical connectors has been shown and described. Each electrical connector contains additional circuitry in the form of conductive traces on the outside surface of the connector. Adjacent electrical connectors may be joined together in a side-by-side fashion to accomplish an electrical connection between the circuitry of two adjacent electrical connectors via mated conductive surface pads. The pad-to-pad mating arrangement of the present invention avoids the need for placing additional circuitry on already crowded printed circuit boards, and takes advantage of the additional "real estate" on the sides of electrical connectors which are mounted on printed circuit boards.

The present invention overcomes the prior art requirement that electrical connectors be mounted onto a PCB board, backplane or flexible circuit and thus be dependent upon these mediums to provide the electrical connection between discrete, adjacent connectors and boards. Additionally, the pad-to-pad mating scheme of the present invention avoids the need to hardwire to make a desired electrical connection to the electrical connectors.

While the invention has been particularly shown and described with reference to a preferred embodiment, it will be understood by those skilled in the art that various changes in form and detail may be made therein without departing from the spirit and scope of the invention.

What is claimed is:

1. An electrical connector structure comprising:

a rigid electrical connector body having a receptacle opening in one longitudinal surface and having a first external surface and a second external surface;

a plurality of first conductive traces being formed along the first external surface;

a plurality of second conductive traces being formed along the second external surface;

electrical components mounted on the body and electrically to one of the plurality of first conductive traces and the plurality of second conductive traces;

a plurality of first surface pads arranged on the first surface and connected to the plurality of first conductive traces, said plurality of first surface pads for connection to a second electrical connector structure; and a second plurality of surface pads arranged on the second surface and connected to the plurality of second conductive traces, said plurality of second surface pads for connection to a third electrical connector structure.

2. The electrical connector structure of claim 1, wherein the plurality of first conductive traces formed along the first external surface of the electrical connector are part of a flexible circuit formed along the first external surface of the electrical connector.

3. The electrical connector structure of claim 1, wherein the plurality of first conductive traces formed along the first external surface of the electrical connector by plating the plurality of first conductive traces on the first external surface.

4. The electrical connector structure of claim 1, wherein the plurality of first conductive traces formed along the first external surface of the electrical connector by screening the plurality of first conductive traces on the first external surface.

5. The electrical connector structure of claim 4, wherein the plurality of first conductive traces are ink electrical traces.

6. The electrical connector structure of claim 4, wherein the plurality of first conductive traces are epoxy electrical traces.

7. The electrical connector structure of claim 1, wherein the plurality of first surface pads are bump pads and the plurality of second surface pads are hollow pads.

8. The electrical connector structure of claim 1, wherein the plurality of first surface pads are bump pads and the plurality of second surface pads are bump pads.

9. The electrical connector structure of claim 1, wherein the plurality of first surface pads are bumps pads and the plurality of second surface pads are flat pads.

10. The electrical connector structure of claim 1, wherein the plurality of first surface pads are solder ball pads, and the first connector is heated to reflow the plurality of first surface pads to the plurality of second surface pads.

11. An electrical connector structure having connections for an external circuit, said electrical connector structure comprising:

an electrical connector having a first side surface, a second side surface, a bottom surface, and a contact for connection to the external circuit; and a flexible circuit with a first portion formed along the first side surface, a second portion formed along the second side surface, and a third portion formed along the bottom surface and connected to the first portion and the second portion of the flexible circuit, said flexible circuit having a plurality of first conductive traces for connection to the external circuit, said plurality of first conductive traces being arranged along the first portion of the flexible circuit and connected to a plurality of first pad elements.

12. The electrical connector structure of claim 11, wherein the plurality of first conductive traces of the first portion are connected to a plurality of second conductive traces of the third portion.

13. The electrical connector structure of claim 11, wherein the second portion of the flexible circuit has a plurality of second conductive traces connected to a plurality of second pad elements.

14. The electrical connector structure of claim 13, wherein the third portion of the flexible circuit has a plurality of third conductive traces connected to the plurality of second conductive traces of the second portion of the flexible circuit.

15. The electrical connector structure of claim 11, wherein the plurality of first pad elements are bump pads.

16. The electrical connector structure of claim 15, wherein the plurality of second pad elements are hollow pads.

17. The electrical connector structure of claim 15, wherein the plurality of second pad elements are bump pads.

18. The electrical connector structure of claim 15, wherein the plurality of second pad elements are flat pads.

19. An electrical connector structure having connections for an external circuit, said electrical connector structure comprising:

a first electrical connector having a first side surface, a second side surface, a bottom surface, and a contact for connection to the external circuit;

a first flexible circuit having a plurality of first conductive traces for connection to the external circuit, said plurality of first conductive traces being arranged along the first side surface of the first electrical connector and connected to a plurality of first pad elements arranged along the first side surface of the first electrical connector and a plurality of second conductive traces for connection to the external circuit, said plurality of second conductive traces being arranged along the second side surface of the first electrical connector and connected to a plurality of second pad elements arranged along the second side surface of the first electrical connector;

a second electrical connector having a first side surface, a second side surface, a bottom surface, and a port for receiving the external circuit; and a second flexible circuit having a plurality of third conductive traces for connection to the external circuit, said plurality of third conductive traces being arranged along the first side surface of the second electrical connector and connected to a plurality of third pad elements arranged along the first side surface of the second electrical connector and a plurality of fourth conductive traces for connection to the external circuit, said plurality of fourth conductive traces being arranged along the second side surface of the second electrical connector and connected to a plurality of fourth pad elements arranged along the second side surface of the second electrical connector;

wherein the plurality of first pad elements are mated to the plurality of third pad elements to make electrical contact between the first electrical connector and the second electrical connector.

20. The electrical connector structure of claim 19, wherein the plurality of first conductive traces of the first side surface of the first electrical connector are connected to a plurality of fifth conductive traces of the third side surface of the first electrical connector.

21. The electrical connector structure of claim 19, wherein the plurality of second conductive traces of the second side surface of the first electrical connector are connected to a plurality of sixth conductive traces of the third side surface of the first electrical connector.

22. The electrical connector structure of claim 19, wherein the plurality of first pad elements are bump pads and the plurality of third pad elements are hollow pads.

23. The electrical connector structure of claim 19, wherein the plurality of first pad elements are bump pads and the plurality of third pad elements are bump pads.

24. The electrical connector structure of claim 19, wherein the plurality of first pad elements are bump pads and the plurality of third pad elements are flat pads.

25. The electrical connector structure of claim 19, wherein the plurality of first pad elements are solder ball pads, and the first connector is heated to reflow the plurality of first pad elements to the plurality of third pad elements.

26. The electrical connector structure of claim 1, wherein said first plurality of traces are connected to said second plurality of traces.

27. An electrical connector structure, comprising:

an electrical connector with a rigid body having an opening for receiving a printed circuit board and having an external surface;

an electrical circuit including a plurality of electrical traces and electrical components, said electrical circuit mounted to said external surface;

said external surface including a first surface and a second surface;

a plurality of first connectors formed on said first surface and a plurality of second connectors on in said second surface, said plurality of first connectors and said plurality of second connectors electrically connected to said electrical circuit.

28. The electrical connector structure of claim 27, wherein said electrical circuit includes electrical traces formed on the external surface of the electrical connector.

29. The electrical connector structure of claim 28, wherein the electrical traces are formed by one of plating, screening, conductive ink, and epoxy.

30. The electrical connector structure of claim 27, wherein the electrical circuit is a flexible surface mounted to the external surface of the electrical connector.

31. The electrical connector structure of claim 27, wherein the plurality of first connectors are protrusions and the plurality of second connectors are receptacles are, said first and second connection formed in the body.

32. The electrical connector structure of claim 30, wherein the plurality of first connectors and the plurality of second connectors are formed in the flexible circuit.

* * * * *